US011840896B2

(12) United States Patent
Paton

(10) Patent No.: US 11,840,896 B2
(45) Date of Patent: Dec. 12, 2023

(54) FLUID COLLECTING DEVICE AND METHOD

(71) Applicant: SUB-DRILL SUPPLY LIMITED, Aberdeenshire (GB)

(72) Inventor: Mark Paton, Aberdeenshire (GB)

(73) Assignee: SUB-DRILL SUPPLY LIMITED

( * ) Notice: Subject to any disclaimer, the term of this patent is extended or adjusted under 35 U.S.C. 154(b) by 156 days.

(21) Appl. No.: 17/423,220

(22) PCT Filed: Mar. 2, 2020

(86) PCT No.: PCT/GB2020/050499
§ 371 (c)(1),
(2) Date: Jul. 15, 2021

(87) PCT Pub. No.: WO2020/178568
PCT Pub. Date: Sep. 10, 2020

(65) Prior Publication Data

US 2022/0106848 A1 Apr. 7, 2022

(30) Foreign Application Priority Data

Mar. 4, 2019 (GB) ..... 1902888

(51) Int. Cl.

| | |
|---|---|
| ***E21B 21/01*** | (2006.01) |
| ***E21B 19/16*** | (2006.01) |
| ***E21B 27/00*** | (2006.01) |
| ***E21B 17/00*** | (2006.01) |

(52) U.S. Cl.
CPC ..... *E21B 21/01* (2013.01); *E21B 17/006* (2013.01); *E21B 19/16* (2013.01); *E21B 27/00* (2013.01)

(58) Field of Classification Search
CPC ..... E21B 19/16; E21B 17/006; E21B 21/01; B08B 9/021; B08B 9/023; B08B 9/032; B08B 9/0321
See application file for complete search history.

(56) References Cited

U.S. PATENT DOCUMENTS

| | | | | |
|---|---|---|---|---|
| 2,522,444 A * | 9/1950 | Grable | E21B 21/01 166/93.1 |
| 3,559,739 A * | 2/1971 | Hutchison | E21B 37/00 166/380 |
| 4,160,457 A * | 7/1979 | Dickson, Jr. | B08B 3/02 134/167 C |
| 4,403,363 A * | 9/1983 | Hess | B08B 9/021 15/104.04 |

(Continued)

OTHER PUBLICATIONS

International Search Report and Written Opinion dated Oct. 6, 2020 issued in corresponding International Application No. PCT/GB2020/050499.

*Primary Examiner* — Robert E Fuller
(74) *Attorney, Agent, or Firm* — Onello & Mello, LLP

(57) ABSTRACT

An apparatus and method for collecting fluid from a drill string or borehole casing includes a collection casing having means for sealably engaging around a drill string or borehole casing to create a chamber between the interior of the collection casing and the drill string or borehole casing, and one or more fluid nozzles for directing cleaning fluid into the interior of the chamber. The one or more nozzles are configured to direct cleaning fluid to impact the inwardly facing interior surface of the collection casing.

17 Claims, 4 Drawing Sheets

(56) References Cited

U.S. PATENT DOCUMENTS

| | | | | |
|---|---|---|---|---|
| 5,295,536 | A | 3/1994 | Bode | |
| 5,857,476 | A * | 1/1999 | Bee | E21B 12/06 134/167 C |
| 6,119,772 | A * | 9/2000 | Pruet | E21B 21/019 175/215 |
| 7,114,235 | B2 | 10/2006 | Jansch et al. | |
| 7,306,032 | B2 | 12/2007 | Paton | |
| 7,371,289 | B2 * | 5/2008 | Reinholdt | B08B 9/021 134/36 |
| 8,763,684 | B2 | 7/2014 | Pearson | |
| 2004/0049905 | A1 | 3/2004 | Jansch et al. | |
| 2005/0155757 | A1 | 7/2005 | Paton | |
| 2007/0256839 | A1 * | 11/2007 | Moynahan | E21B 17/006 166/312 |
| 2011/0265992 | A1 | 11/2011 | Pearson | |

* cited by examiner

FLUID COLLECTING DEVICE AND METHOD

FIELD OF THE INVENTION

The present invention relates to fluid collecting devices used when disconnecting drill string pipes or borehole casings and in particular, to a fluid collecting device in the form of a mud bucket for use in the oil production industry.

BACKGROUND OF THE INVENTION

As is well known, borehole drilling is generally carried out by means of a drill bit at the end of a string of hollow tubulars connected together. The connections between the tubulars are sufficiently strong to transmit the torque involved in drilling and also to provide a mechanical seal to prevent leakage of the drilling mud, which is pumped down the drill string to lubricate the bit, balance the hydrostatic dressing in the rock formation, and carry the cuttings back to the surface.

Drilling mud can contain a variety of chemicals, and for cost, environmental and safety reasons, it is desirable that spillage of mud in a drilling rig should be kept to a minimum.

In the case of drill string pipes, these are generally connected together in approximately 27 metre-long (90 feet) stands consisting of three 9 meter (30 feet) lengths joined together. Depending on its internal diameter, each stand can contain a considerable amount of mud. For example, the internal volume of 27 meters (90 feet) of pipe with an internal diameter of 63.5 mm (2½ inches) is substantially 85.5 litres.

In this connection, when withdrawing the drill string from the borehole, a large proportion of mud can remain in the drill string pipe, and this will escape when each stand is disconnected unless measures are taken to prevent this from happening. A device commonly used to contain such leakage is referred to as a mud bucket, and generally consists of a pair of half cylindrical can components which are clamped around the drill string pipe connection or borehole casing connection when it has been sufficiently loosened, but further rotation requires relatively little torque, and significant leakage has not occurred. Mud escaping from the area of the joint is collected by the mud bucket and usually returned to the mud pit/mud tanks to be re-used.

The mud bucket can be deployed either by suspension from a wire, connected to a hoist, or can be automatically moved into position by mechanical arms and other robotic devices. Such a fluid collecting device is disclosed in U.S. Pat. No. 7,306,032.

A problem with such known devices is that an amount of mud is inevitably retained within the mud bucket and on the drill string pipes and borehole casing within the mud bucket, namely within the cavity between the half cylindrical casing shell and the drill string pipe or borehole casing. As such, once the mud bucket is released in order that it can be applied to a new section of drill string or borehole casing, any such mud that is retained within its interior can leak out undesirably and, in addition, the drill string pipes or casings will also be coated in drilling mud. The present invention seeks to alleviate such problems.

SUMMARY OF THE INVENTION

According to an aspect of the present invention, there is provided apparatus for collecting fluid from a drill string or from a borehole casing, the apparatus comprising a collection casing having means for sealably engaging around a drill string or borehole casing to create a chamber between the interior of the collection casing and the drill string or borehole casing, and one or more fluid nozzles for directing fluid into the interior of the chamber, wherein the one or more nozzles are configured to direct cleaning fluid to impact the inwardly facing interior surface of the collection casing. In this way, fluid such as compressed air, can be injected into the interior of the chamber to ensure that no or reduced mud is retained within the interior of the chamber before the collection casing is released from sealing engagement with the drill string or borehole casing. The collection casing may, in this regard, be formed of a pair of half cylindrical can components.

Preferably, the one or more nozzles are provided at an upper region of the collection casing and configured for directing cleaning fluid in a substantially downward direction.

Conveniently, the one or more nozzles are configured to direct cleaning fluid such that it contacts substantially the entire internal surface of the chamber formed between the collection casing and the drill string or borehole casing.

Preferably, the apparatus further comprises a pressure relief valve for relieving pressure within the chamber. The pressure relief valve can in this respect accommodate potentially dangerous spikes is pressure within the chamber, for example from accidental activation of mud pumps.

Conveniently, the apparatus further comprises a drain at a lower region of the collection casing for collecting drilling mud cleaned off the interior surface of the chamber. The drain can be from 2 to 36 inch diameter (50.8 mm to 914.4 mm). Preferably, the drain is from 2 to 10 inch (50.8 mm to 254 mm). The drain preferably has a plurality of outlets, each of which can be opened or blanked off as required to meet in situ configuration requirements.

In preferred embodiments, the apparatus is configured to be mounted to a drill string or borehole casing either side of a joint between two drill string sections or borehole casing sections. As such, the apparatus establishes a chamber that captures any mud escaping from the joint as it is loosened.

Preferably, the one or more nozzles direct air into the chamber. Whilst any suitable fluid may be used, air has the advantage that it will not contaminate the mud material so that it can be re-used.

Conveniently, the one or more nozzles create an air curtain. The air curtain is arranged to urge mud to move downwardly within chamber and to exit via a drain.

Preferably, 2 to 18 nozzles are provided.

Conveniently, 6 to 8 nozzles are provided and more preferably, 6 nozzles are provided. Conveniently, the nozzles are spaced equidistantly around the periphery of the collection casing.

The nozzles may be provided at different axial extents along the longitudinal extent of the collection casing. Conveniently, the nozzles at different adjacent axial extents are circumferentially offset from one another.

In another embodiment, the nozzles may be mounted within the chamber such that they can move up and down inside the chamber to create a moving air curtain. In this regard, two shell-like halves may be provided within the chamber with the nozzles movably mounted thereon so that they can move up and down inside the chamber to create a moving air curtain.

Fluid to different nozzles may be provided at controlled timings so that a sweeping pattern, pulse or wave can be created. As such, the control of fluid to the nozzles may be orchestrated to optimal effect.

Preferably, the collection casing is provided as two shell components, which are closable together about the exterior of the drill string or borehole casing. The two shell components may be provided as half cylindrical cans.

Conveniently, the nozzles and a closing mechanism for closing the collection casing components together share a common fluid supply.

Preferably, the nozzles are provided within the wall of the collection casing. The nozzles may, in this respect, be mounted within the half cylindrical cans.

The collection casing may, in certain embodiments, be enclosed within an external frame formed of two or more sides, the frame housing components for delivering fluid to the one or more nozzles. Such components may comprise a control panel and ducting to the nozzles. Another use for the frame is to protect operators or rig crew from pinch points/crushing points created by the movement of the mud bucket from open position to the closed position.

An over-centre lever mechanism may be provided for clamping the collection casing components together with sufficient force to create an effective seal around the drill string pipes or borehole casing.

According to a further aspect of the present invention there is provided a method for collecting fluid from a drill string or borehole casing, the method comprising the steps: engaging a collection casing around a drill string or borehole casing thereby creating a chamber between the interior of the collection casing and the drill string or borehole casing; directing cleaning fluid into the interior of the chamber by way of one or more nozzles, the one or more nozzles being configured to direct cleaning fluid to impact the inwardly facing interior surface of the collection casing.

Preferably, the one or more nozzles are provided at an upper region of the collection casing and direct cleaning fluid in a substantially downward direction.

Conveniently, the one or more nozzles direct cleaning fluid such that it contacts substantially the entire internal surface of the chamber formed between the collection casing and the drill string or borehole casing. In this connection, the more or more nozzles may create a moving fluid curtain.

Certain embodiments of the present invention will now be described by way of example, and with reference to the following drawings of which:

DETAILED DESCRIPTION OF EMBODIMENTS

Figure 1:
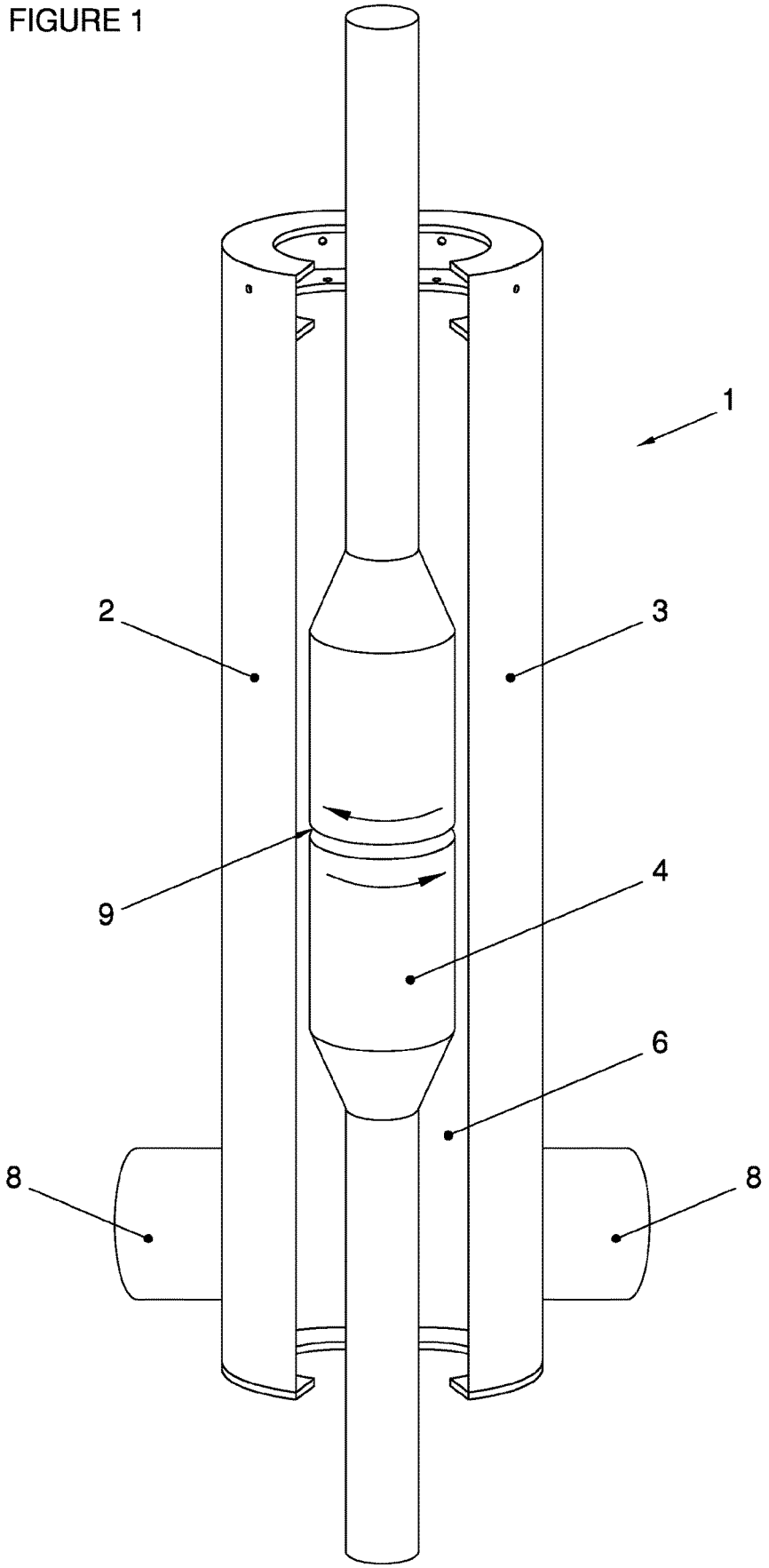
FIG. 1 shows a perspective view of a fluid collecting apparatus in an open position around a drill string pipe section.
Figure 2:
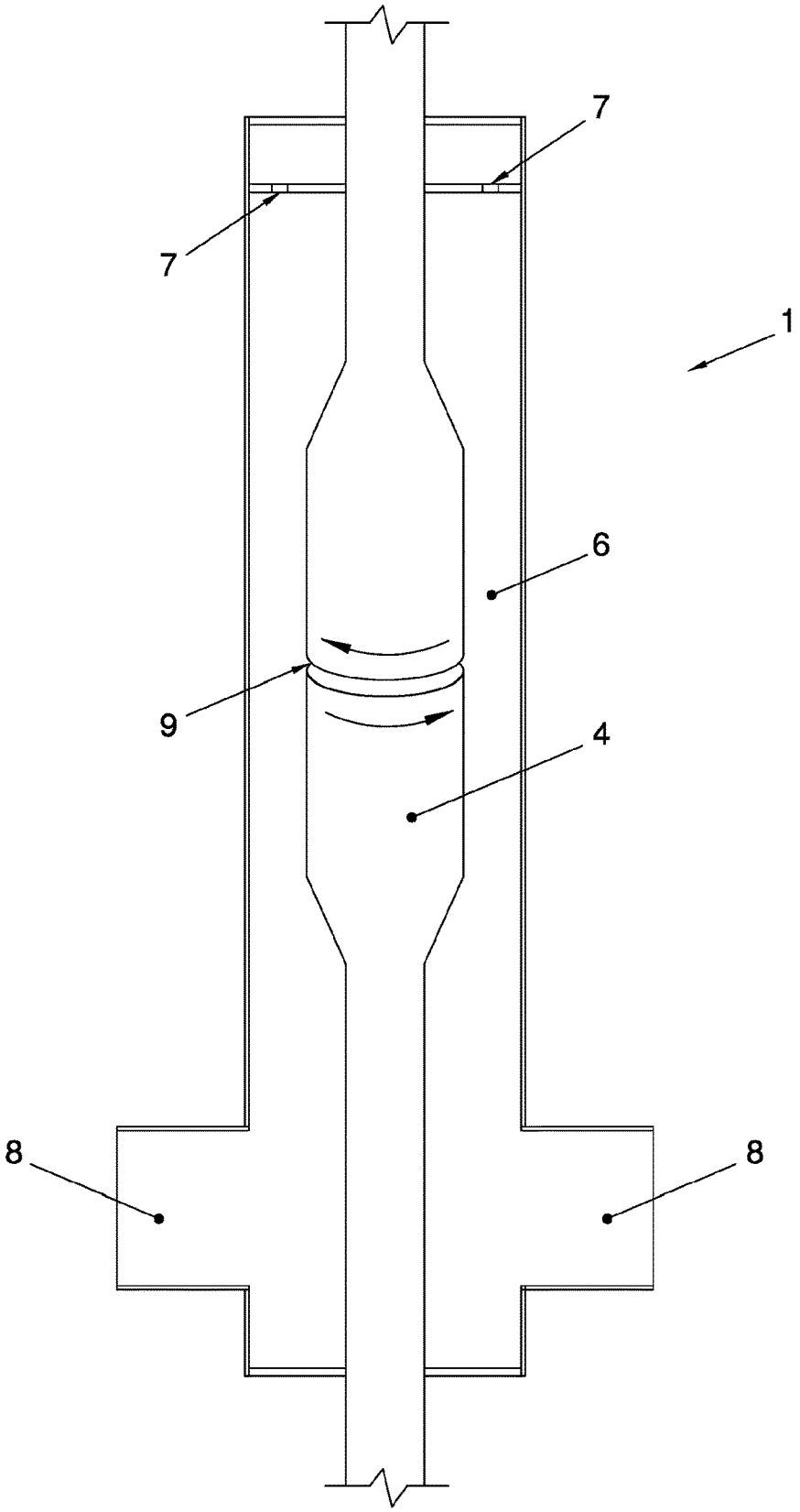
FIG. 2 shows a part cross-sectional view of the fluid collecting apparatus of FIG. 1 in a closed or deployed configuration around the drill string pipe section.
Figure 3:
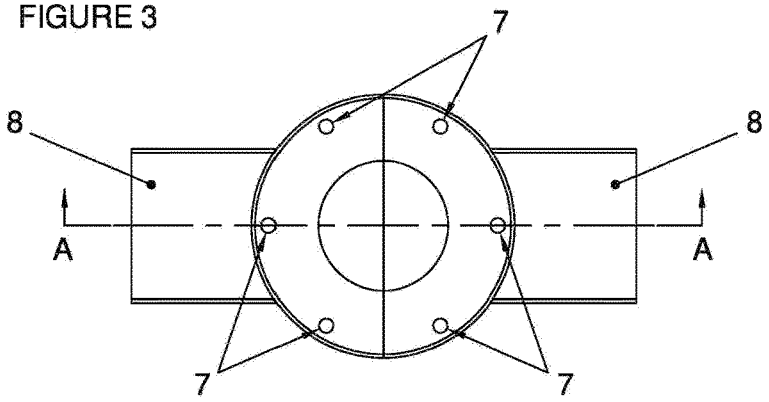
FIG. 3 shows a plan view from above of the apparatus of FIGS. 1 and 2.

As shown in FIGS. 1 and 2, the apparatus 1 takes the form of a collection casing comprising two half cylin- drical cans 2, 3 which are hingably connected so that they can sealably engage about the exterior of drill string pipe section 4. If used with a borehole casing, the apparatus can equally engage around a j oint in the borehole casing. A suitable closing mechanism, such as an over-centre lever, ensures that the two shell or can components, 2, 3, sealably engage about the drill string pipe section to prevent mud leakage from the interior of cavity 6 defined between the collection casing components and the exterior surface of the drill string pipe section 4.

Nozzles 7 are provided to allow a fluid flow to be injected into the cavity 6. The nozzles may be integrated into the collection casing wall or mounted thereon, or may be provided on a movable structure on the inside of the collection casing. The fluid flow urges any material within the cavity 6 down towards drain 8.

In use, the apparatus is clamped to the drill string pipe section at the junction 9 of two pipe sections as shown in FIGS. 1 and 2. A relative rotation is applied to the sections either side of the junction 9 so that they become disconnected. This results in mud that has been retained within the sections escaping into the cavity 6.

However, without further assistance, a certain amount of mud would be retained within the cavity 6 and on the drill string pipes 4, and would not exit via drain 8. As such, in order to ensure mud material is not retained within the cavity or on the drill string pipes, cleaning fluid, for example air, is supplied to nozzles 7 to urge any such mud material downwardly and out through drain 8.

Figure 4:
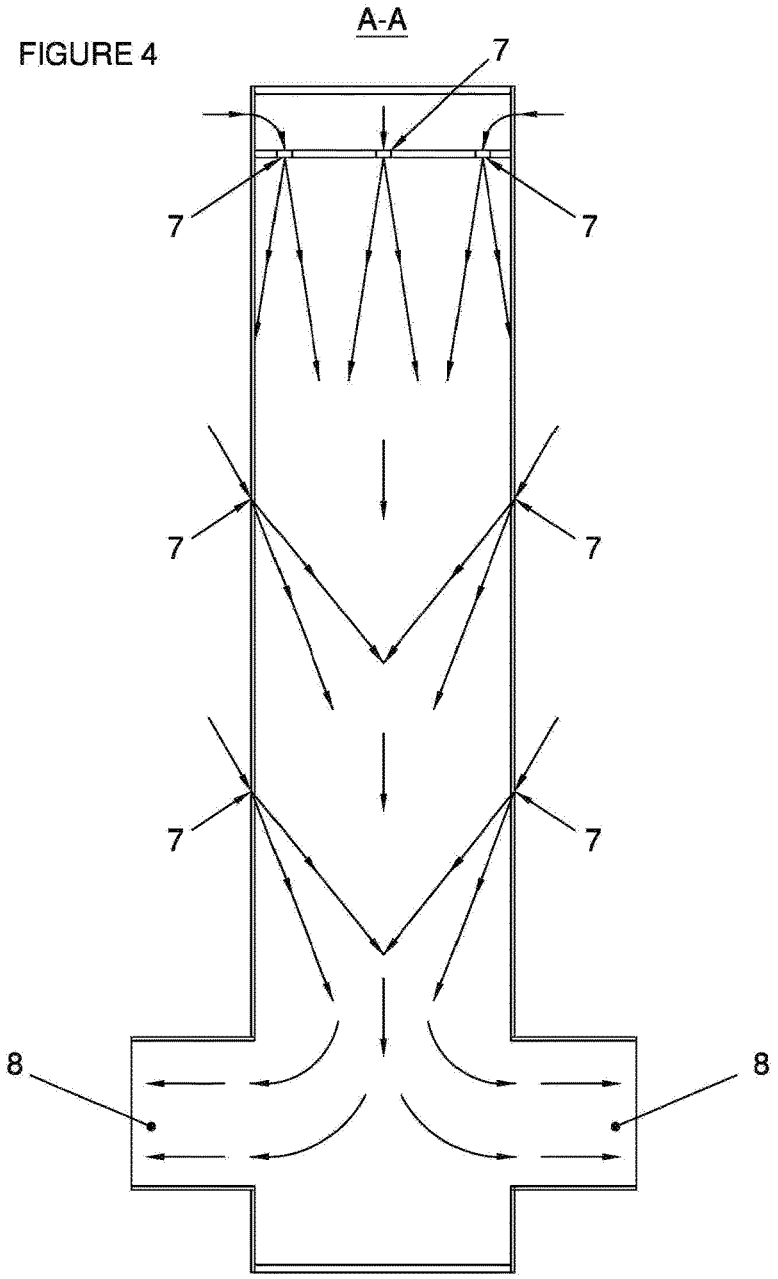
FIG. 4 shows a cross-section view of the apparatus of the present invention, showing nozzle fluid flows.

As shown in FIG. 4, the nozzles are arranged to direct cleaning fluid to impact the inwardly facing interior surface of the collection casing. The nozzles at the upper region of the collection casing are in this regard configured to direct cleaning fluid in a substantially downward direction. As a result, cleaning fluid is directed down the internal surfaces of the collection casing, including the inward facing walls of the collection casing and the surface of the drill string (or when used with a borehole casing, the exterior surface of the borehole casing).

The injected fluid can be in this connection be directed to set up an air curtain within the cavity that drives any mud downwardly and out of drain 8.

In a further embodiment, the nozzles may be configured such that the air curtain can travel up and down the length of the collection casing. In this connection, the nozzles may be mounted on a movable support that can travel up and down within the collection casing. The movable support may in this respect take the form of an internal casing that is slidably received within the casing. The internal casing may be formed of two or more sections coupled together to form an annular member having a diameter slightly smaller than the internal diameter of the collection casing.

The nozzles are generally provided equidistantly around the circumference of the apparatus. Whilst any suitable number of nozzles may be provided, 2 to 18 are generally sufficient. In preferred embodiments 6 or 18 such nozzles are provided.

The fluid is supplied to the nozzles for a sufficient period substantially in the region of 5 to 10 seconds to ensure that all mud is dispersed from the cavity 6.

As mentioned above, the fluid used for cleaning the interior of the cavity can be air provided at between 80 and 120 psi and more preferably between 90 and 110 psi. In this regard, air can be sourced from the same supply used to control the closing mechanism for sealably locking the shell components together around the pipe exterior.

It has been found that use of the present apparatus can save around 2 to 25 litres of mud from being lost from the chamber.

In further embodiments, the nozzles may be provided at different axial extents of the collection casing to further enhance the cleaning effect. In such a case, the nozzles at different axial extents may be circumferentially offset with corresponding nozzles provided at adjacent axial extents to ensure a uniform fluid flow is maintained.

A control means may be used to control the provision of air to the nozzles, so that air waves, pulses or sweep patterns can be created to enhance the cleansing effect.

Water may be used as an alternative to air with a requirement being that the mud is not contaminated so that it can be re-used.

Figure 5:
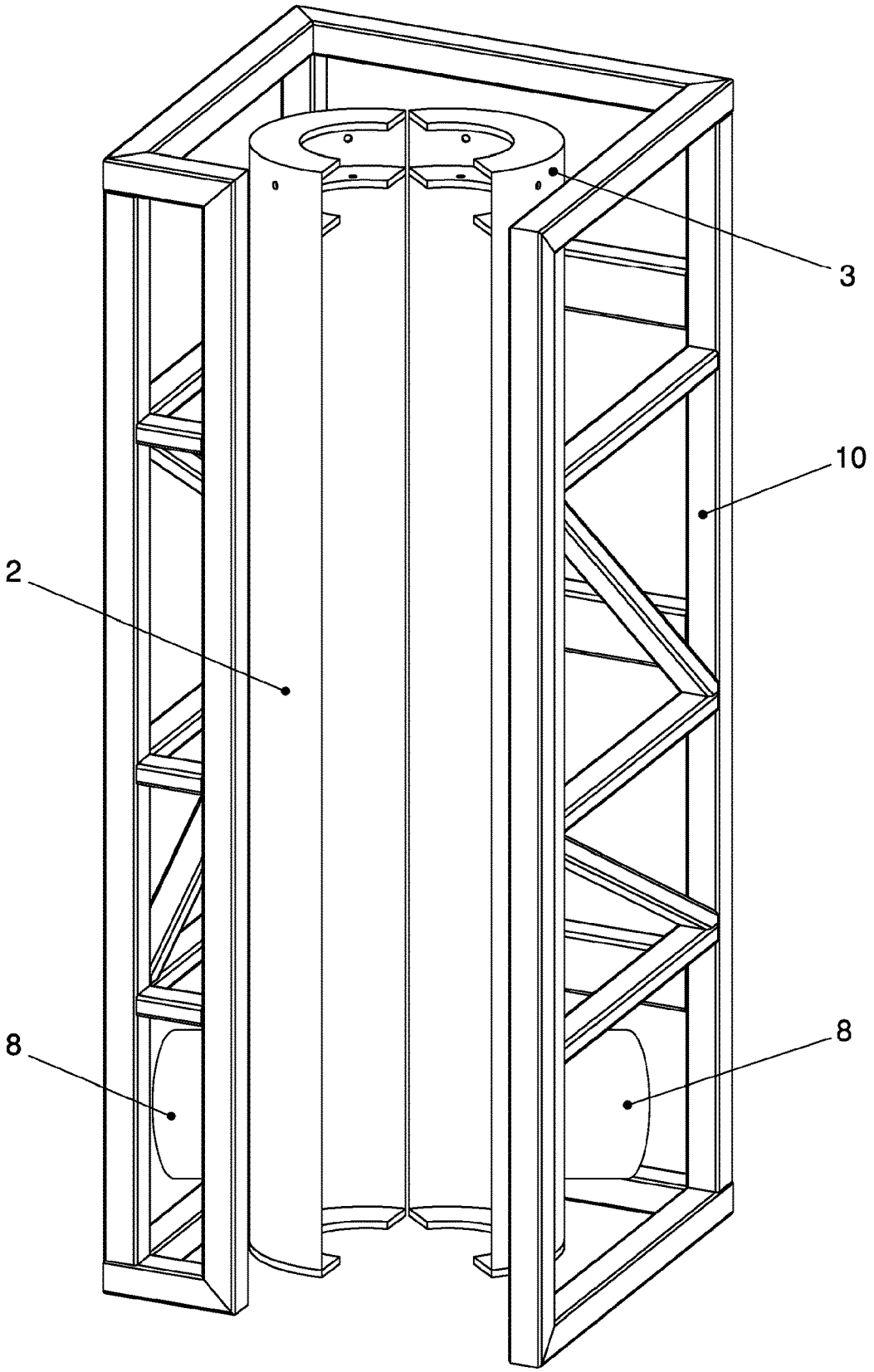
FIG. 5 shows an exterior frame for use with the present invention.

FIG. 5 shows an embodiment having an external frame 10 which encloses the collection casing 2, 3 on at least three sides. The frame protects components of the apparatus on the outside of the collection casing from damage and also protects operators/rig crew from pinch points created during the operation of the mud bucket. Such components may include a control panel and ducting for the injected fluid.

The invention claimed is:

1. Apparatus for collecting fluid from a drill string or from a borehole casing, the apparatus comprising a collection casing having means for sealably engaging around a drill string or borehole casing to create a chamber between an interior of the collection casing and the drill string or borehole casing, and one or more fluid nozzles for directing cleaning fluid into an interior of the chamber, wherein the one or more nozzles are configured to direct cleaning fluid to impact an inwardly facing interior surface of the collection casing.

2. The apparatus as claimed in claim 1, wherein the one or more nozzles are provided at an upper region of the collection casing and configured for directing cleaning fluid in a substantially downward direction.

3. The apparatus as claimed in claim 1, wherein the one or more nozzles are configured to direct cleaning fluid to contactsuch that it contacts substantially anthe entire internal surface of the chamber formed between the collection casing and the drill string or borehole casing.

4. The apparatus as claimed in claim 1, further comprising a pressure relief valve for relieving pressure within the chamber.

5. The apparatus as claimed in claim 1, further comprising a drain at a lower region of the collection casing for collecting drilling mud cleaned off the interior surface of the chamber.

6. The apparatus as claimed in claim 1, further comprising an external frame enclosingte the collection casing, the frame having two or more sides.

7. The apparatus as claimed in claim 1, wherein the one or more nozzles direct air into the chamber.

8. The apparatus as claimed in claim 1, wherein the one or more nozzles create an air curtain.

9. The apparatus as claimed in claim 1, wherein 2 to 18 nozzles are provided.

10. The apparatus as claimed in claim 9, wherein 6 to 8 nozzles are provided.

11. The apparatus as claimed in claim 1, wherein the one or more nozzles comprise a plurality of nozzles and the plurality of nozzles are spaced equidistantly around the periphery of the collection casing.

12. The apparatus as claimed in claim 1, wherein wherein the one or more nozzles comprise a plurality of nozzles an the plurality of nozzles are provided at different axial extents along the longitudinal extent of the collection casing.

13. The apparatus as claimed in claim 12, wherein the nozzles at adjacent axial extents are circumferentially offset from one another.

14. The apparatus as claimed in claim 1, wherein the collection casing is provided as two shell components which are closable together about an exterior of the drill string or borehole casing.

15. A method for collecting fluid from a drill string or from a borehole casing comprising:

engaging a collection casing around a drill string or borehole casing thereby creating a chamber between an interior of the collection casing and the drill string or borehole casing; and directing cleaning fluid into an interior of the chamber by way of one or more nozzles, the one or more nozzles being configured to direct cleaning fluid to impact an inwardly facing interior surface of the collection casing.

16. A method as claimed in claim 15, wherein the one or more nozzles are provided at an upper region of the collection casing and direct cleaning fluid in a substantially downward direction.

17. A method as claimed in claim 15, wherein the one or more nozzles direct cleaning fluid to contact substantially an entire internal surface of the chamber formed between the collection casing and the drill string or borehole casing.

* * * * *